US008690044B2

(12) United States Patent
Monti

(10) Patent No.: US 8,690,044 B2
(45) Date of Patent: Apr. 8, 2014

(54) CARDBOARD CONTAINER FOR RECEIVING BOTTLES IN A VERTICAL CONFIGURATION AND A BLANK FOR OBTAINING THE CONTAINER

(71) Applicant: Marchesini Group S.p.A., Pianoro (IT)

(72) Inventor: Giuseppe Monti, Pianoro (IT)

(73) Assignee: Marchesini Group S.p.A., Pianoro (Bologna) (IT)

( * ) Notice: Subject to any disclaimer, the term of this patent is extended or adjusted under 35 U.S.C. 154(b) by 0 days.

(21) Appl. No.: 13/716,408

(22) Filed: Dec. 17, 2012

(65) Prior Publication Data

US 2013/0153649 A1 Jun. 20, 2013

(30) Foreign Application Priority Data

Dec. 20, 2011 (IT) ..... BO2011A0736

(51) Int. Cl.
*B65D 5/488* (2006.01)
*B65D 25/04* (2006.01)

(52) U.S. Cl.
USPC ..... 229/120.18; 206/427; 229/120.09

(58) Field of Classification Search
USPC ..... 229/120.08, 120.09, 120.14, 120.18, 229/120.24, 120.26; 206/170, 174, 175, 206/427
See application file for complete search history.

(56) References Cited

U.S. PATENT DOCUMENTS 2,144,774 A * 1/1939 Richards et al. ..... 229/120.18
2,794,585 A * 6/1957 Wagner ..... 229/120.18
2,895,662 A * 7/1959 Vines ..... 229/120.14
3,047,201 A 7/1962 Kuchenbecker
3,351,182 A * 11/1967 Greer et al. ..... 229/120.18
3,536,246 A * 10/1970 Rosen Shy ..... 229/120.24
3,624,790 A 11/1971 Stout
3,845,898 A * 11/1974 Hackenberg ..... 229/120.26
3,958,745 A * 5/1976 Lindsay ..... 229/120.26
5,267,645 A * 12/1993 Tokunaga et al. ..... 229/120.26
5,372,299 A * 12/1994 Edgerton et al. ..... 206/427
6,196,449 B1 * 3/2001 Chen ..... 229/120.26
8,191,762 B2 * 6/2012 Philips ..... 229/120.18
2008/0237326 A1 10/2008 Bates

OTHER PUBLICATIONS

European Search Report for Corresponding application No. EP12196772, completed Mar. 25, 2013, 2 pages.

* cited by examiner

*Primary Examiner* — Gary Elkins
(74) *Attorney, Agent, or Firm* — William J. Sapone; Ware Fressola; Maguire & Barber LLP

(57) ABSTRACT

A cardboard container has a base wall, a first foldable lateral wall, and a tab which exhibits a first portion foldable with respect to a first transversal edge. A second portion, foldable relative to the first portion, has a first side and a second side at different distances from the first portion. A foldable third portion is connected to the first lateral wall and foldable relative to the first lateral wall. A fourth portion, foldable relative to the second side, is connected to the first lateral wall and foldable relative thereto. When the container is opened-out, the tab is foldable for arranging the second portion opposite the first lateral wall, the first portion, the third portion and the fourth portion are arranged at an angle with respect to the first lateral wall and the second portion, so as to identify respective seatings for receiving corresponding bottles.

19 Claims, 3 Drawing Sheets

CARDBOARD CONTAINER FOR RECEIVING BOTTLES IN A VERTICAL CONFIGURATION AND A BLANK FOR OBTAINING THE CONTAINER

FIELD OF THE INVENTION

The present invention relates to the technical sector regarding packing bottles, for example bottles containing pharmaceutical or cosmetic products.

DESCRIPTION OF THE PRIOR ART

In this specific technical sector a process usually carried out for packing bottles includes positioning the bottles, in a vertical configuration, in a relative support container, and then inserting the container containing the bottles internally of a relative box, so as to obtain the final pack. The containers used for supporting the bottles can for example be made of a plastic material. The containers are obtained following a heat forming process so as to exhibit a series of vertical housing in which the bottles are positioned. For example, they can comprise one row only of housings, or also two or more flanked rows of housings, according to the type of pack which is to be obtained or also to the dimensions of the bottles.

This type of container exhibits a structure that in itself is rigid, and therefore stable and suitable for containing the bottles, and the housings can be made very close to one another, enabling obtaining very modest transversal dimensions.

However, a container made in this way exhibits an unreduceable volume, a circumstance that can be disadvantageous in terms of space and in terms of the dimensions required for predisposing the stores in the machines for performing packing automatically and/or semi-automatically.

Also known is the use of cardboard containers which are obtained starting from flat blanks which, once realized according to paper industry processes, are folded about relative fold lines so as to form the container.

The container thus obtained exhibits the peculiarity of exhibiting a much smaller volume in comparison to plastic containers, as it can be kept in a flattened configuration, with the aim of facilitating storage thereof and, when the bottles are inserted, it can be brought into an opened-out configuration.

The use of cardboard containers undoubtedly exhibits the advantage of being stockable in considerably smaller stores with respect to the case of the use of plastic containers.

Usually prior art cardboard containers exhibit a base wall, a first lateral wall which is in a single piece with the base wall, at a first longitudinal side thereof, and a second lateral wall which is fixed, for example by gluing, to the base wall at the relative second longitudinal side, and an upper wall, in a single piece with the two lateral walls, which upper wall is provided with through-holes for inserting bottles in a vertical configuration.

For example, the holes can be arranged along a single row, or can be in two or more flanked rows.

The two lateral walls are foldable both with respect to the base wall and to the upper wall so as to enable the container to take on both a flattened configuration and to be assemblable into an opened-out use configuration.

In the flattened configuration, the first lateral wall is arranged externally and on a same plane as the base wall, the second lateral wall is instead arranged above and in contact with the base wall and the upper wall is arranged above and in contact with the base wall and with the first lateral wall.

The fact that the upper wall of the container is in a single body with the two lateral walls lends a certain "heaviness" to the container, when it is placed into the opened-out configuration, and the lateral walls therefore tend to flex.

Further, the upper wall must exhibit dimensions such that the through holes are not too close to one another, nor to the lateral walls, which would weaken it and would not enable positioning the bottles present therein with a sufficient stability.

Consequently, the dimensions of the upper wall, and therefore the base wall too, are designed in such a way that there is a certain space both between a hole and another hole and also a certain space between the holes and the lateral walls, so as to combat undesired flexing and/or bending of the parts of the upper wall about the holes when the bottles are inserted.

This however leads inevitably to realizing cardboard containers which exhibit dimensions in both the transversal direction and the longitudinal direction that are greater than those of containers made of a plastic material.

Consequently and disadvantageously there will be the need to change the dimensions of the boxes in a case in which the bottles are to be packed using a support container made of cardboard rather than of a plastic material.

The aim of the present invention is therefore to provide a new cardboard container for housing bottles in a vertical configuration, and a new blank usable so as to obtain the container, following the folding thereof, which obviates the drawbacks present in the prior art, both those produced by the use of containers made of heat-formed plastic material and those produced by the use of cardboard containers obtained from relative blanks, such as the ones described above.

SUMMARY OF THE INVENTION

In particular, an aim of the present invention is to provide a new container for receiving bottles in a vertical configuration which can take on a flattened configuration, and which, once opened out to receive the bottles, exhibits modest dimensions both in a transversal direction and in a longitudinal direction, i.e. dimensions in the transversal and the longitudinal directions that are smaller than those of the prior art cardboard containers and comparable to those of the plastic containers. The aims are entirely obtained according to the present invention which comprises a cardboard container for receiving bottles in a vertical configuration, of a type having a base wall, two lateral walls which are in a single body with the base wall, with a relative longitudinal side respectively at two opposite longitudinal sides of the base wall and which are foldable with respect to the base wall so as to enable the container to take on a flattened configuration and an opened-out configuration. The container has at least one tab, in a single body with a first lateral wall of the two lateral walls at a first transversal edge thereof. The tab exhibits a first portion which is foldable with respect to the first transversal edge of the first lateral wall, a second portion which is foldable with respect to the first portion and which is of such a shape as to exhibit a first side and a second side which are at a different distance from the first portion. A third portion is foldable with respect to the first side of the second portion and is connected to the first lateral wall in a first position with respect to the first transversal edge so as to be foldable also with respect to the first lateral wall. A fourth portion is foldable with respect to the second side of the second portion and is connected to the first lateral wall in a second position with respect to the first transversal edge so as to be foldable also with respect to the first lateral wall. The two lateral walls are foldable with respect to the base wall so as to be arrangeable on a same plane containing the base wall, externally of the two opposite longitudinal sides of the base wall, and with the tab being foldable such that the first portion thereof becomes arranged by a flank of the first lateral wall and on the same plane as the first lateral wall and that the relative second portion, third portion and fourth portion take on a flat configuration and are arranged on a same common plane above the first lateral wall and the first portion, such that the container can take on the flattened configuration. The two lateral walls are further foldable with respect to the base wall so as to be arrangeable opposite to one another and to form an angle with respect to the base wall, and with the tab foldable with respect to the first lateral wall, such that the second portion is arranged between the two lateral walls and opposite the first lateral wall, such that the first portion, the third portion and the fourth portion are arranged at an angle both with respect to the first lateral wall and the second portion, so as to identify, between the first portion and the third portion, and between the third portion and the fourth portion, respective seatings of dimensions suitable for receiving corresponding bottles, with the container taking on the opened out configuration for receiving a corresponding bottle in a vertical configuration in each of the seatings with the bottom of the bottle resting on the base wall.

Other particular characteristics of the cardboard container of the invention are described further below.

A further aim of the invention is to provide a new blank, which enables obtaining, once folded, the container of the present invention.

BRIEF DESCRIPTION OF THE DRAWINGS

The characteristics of the invention will become clear from the following description of a preferred but not exclusive embodiment of a cardboard container for housing bottles in a vertical configuration and a blank from which the container is obtained, made with reference to the accompanying tables of drawings, in which.

DESCRIPTION OF PREFERRED EMBODIMENTS

With reference to the accompanying figures, (100) denotes the cardboard container for receiving bottles in a vertical configuration, and (F) denotes the blank, usable for obtaining, after a folding operation, the container (100), disclosed by the present invention.

Figure 1:
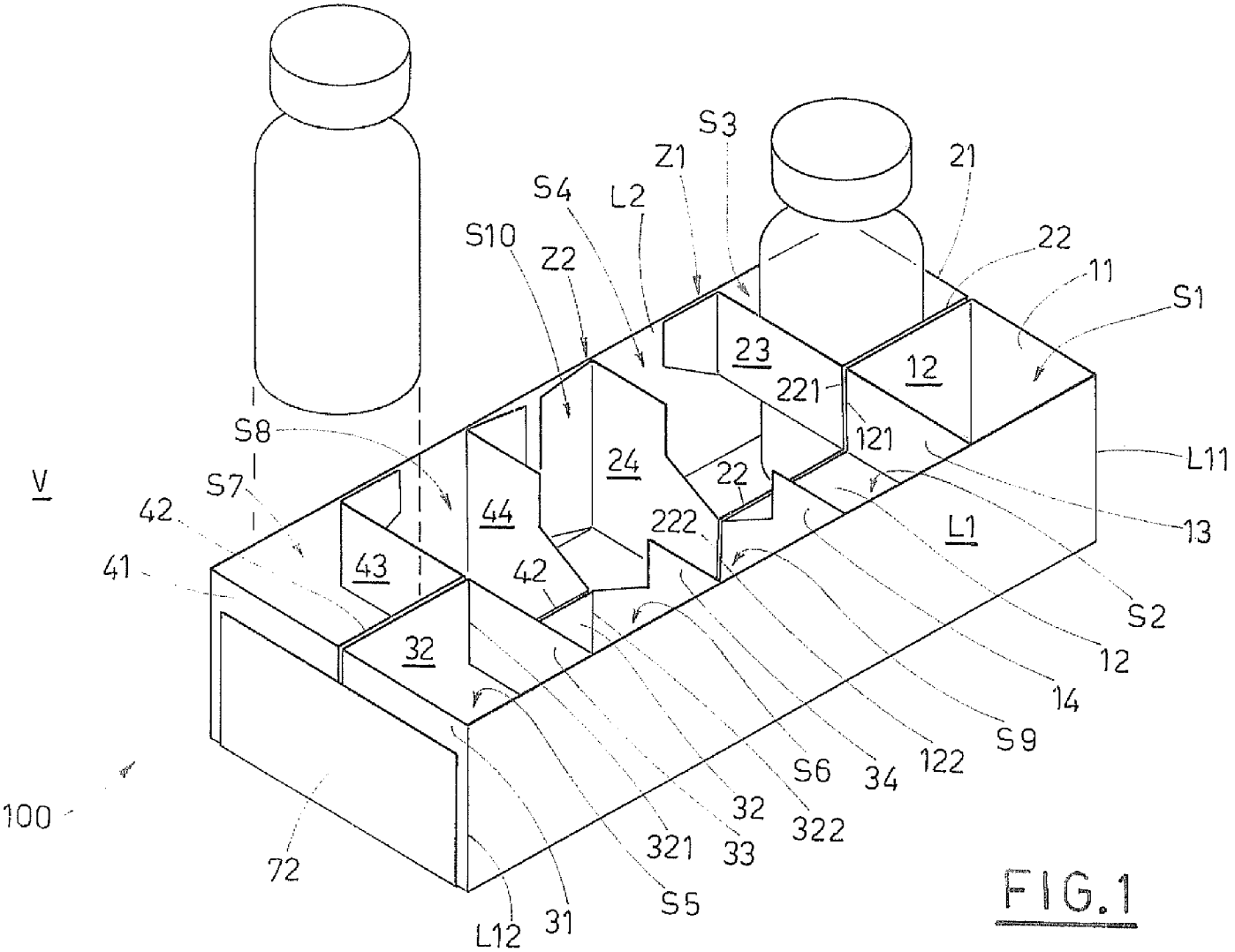
FIG. 1 illustrates, in a perspective view, the cardboard container for receiving bottles in a vertical configuration of the invention, in the opened-out configuration ready to receive the bottles.
Figure 2:
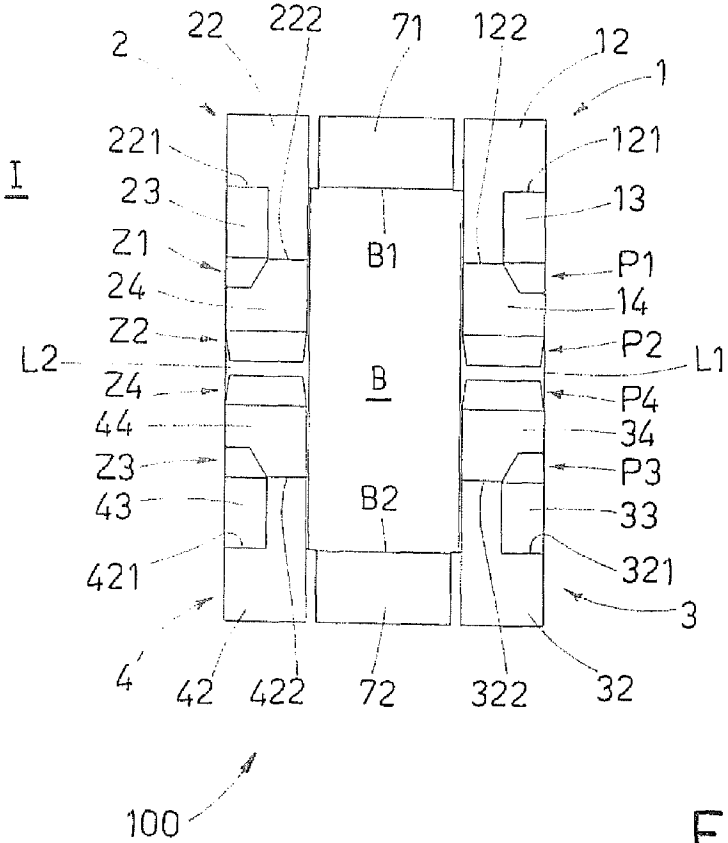
FIG. 2 is a view from above of the cardboard container of the invention in the flattened configuration thereof, for storing in a relative store (not illustrated) provided in automatic and/or semi-automatic machines.
Figure 5:
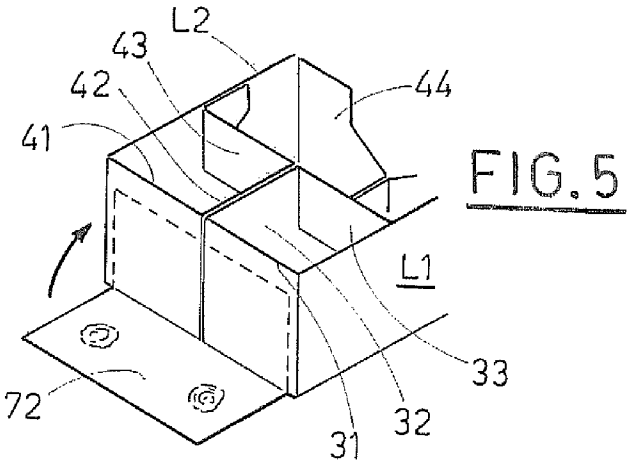
FIG. 5 illustrates, in a partial and perspective view, the cardboard container of the invention in a final step of completion of the opened-out configuration; and, FIG. 6 illustrates the opened-out container in a view from above.
Figure 6:
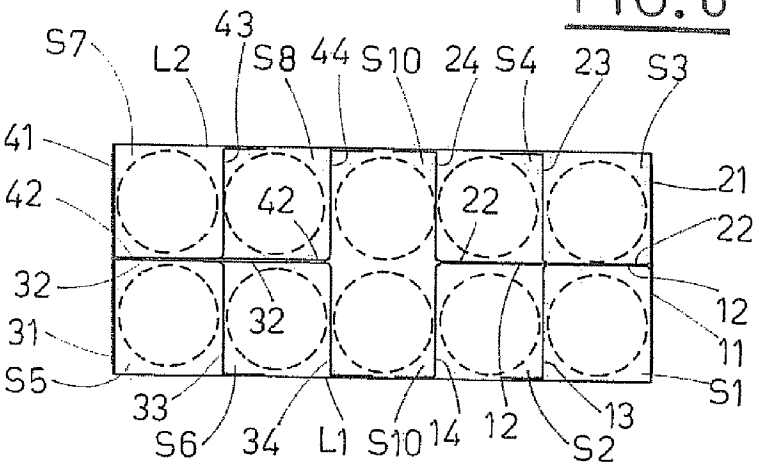

The cardboard container (100) comprises, as for example is clearly visible in FIG. 2, a base wall (B) and two lateral walls (L1, L2) which are in a single body with the base wall (B) with a relative longitudinal side respectively at two opposite longitudinal sides of the base wall (B). The two lateral walls (L1, L2) are foldable with respect to the base wall (B) (see for example FIG. 4 where a folding step of the lateral walls (L1, L2) is illustrated with respect to the base wall (B)), so as to enable the container (100) to take on a flattened configuration (I) (illustrated in FIG. 2) and an opened-out configuration (V) (illustrated in FIG. 1).

The container (100) of the present invention is distinguished with respect to the cardboard containers of the prior art as it comprises at least a tab (1), in a single body with a first lateral wall (L1) of the two lateral walls (L1, L2) at a first transversal edge (L11) thereof.

The tab (1) has a special shape as it exhibits:

a first portion (11) which is foldable with respect to the first transversal edge (L11) of the first lateral wall (L1), a second portion (12), which is foldable with respect to the first portion (11) and which is of such a shape as to exhibit a first side (121) and a second side (122) which are at a different distance from the first portion (11), a third portion (13), which projects from the first side (121) and which is foldable with respect to the first side (121) and which is also connected (for example by gluing) to the first lateral wall (L1) in a first position (P1) with respect to the first transversal edge (L11) in such a way as to be foldable also with respect to the first lateral wall (L1), and a fourth portion (14), which projects from the second side (122) of the second portion (12) and is foldable with respect thereto, and which is also connected (for example by gluing) to the first lateral wall (L1) in a second position (P2) with respect to the first transversal edge (L11) in such a way as to be foldable also with respect to the first lateral wall (L1).

Further, another special feature of the container (100) of the invention consists of the fact that the two lateral walls (L1, L2) are foldable with respect to the base wall (B) in such a way as to be arrangeable on a same plane as contains the base wall (B), externally of the two opposite longitudinal sides of the base wall (B) (see FIG. 2), and with the tab (1) being foldable in such a way that the first portion (11) thereof becomes arranged by a flank of the first lateral wall (L1) and on the same plane as the first lateral wall (L1) and that the relative second portion (12), third portion (13) and fourth portion (14) take on a flat configuration and are arranged on a same common plane above the first lateral wall (L1) and the first portion (11), in such a way that the container (100) can take on the flattened configuration (I) (in FIG. 2 the first portion (11) of the tab (1) is not visible as it situated below the second portion (12)).

Figure 4:
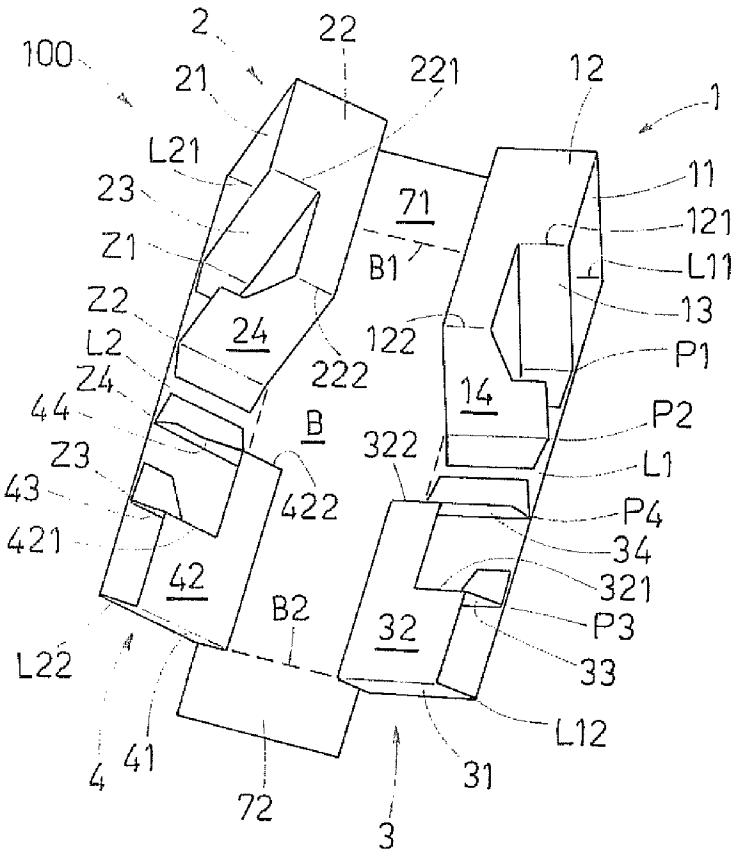
FIG. 4 illustrates, in a perspective view, the cardboard container of the invention in a passage step from the flattened configuration of FIG. 2 into the opened-out configuration in FIG. 1.

A further peculiarity of the container (100) relates to the fact that the two lateral walls (L1, L2) are also foldable with respect to the base wall (B) in such a way as to be arrangeable opposite to one another and in such a way as to form an angle with respect to the base wall (B), for example by 90° (see for example first FIG. 4, wherein the two lateral walls (L1,L2) are folded with respect to the wall and then FIG. 1 in which the two lateral walls (L1,L2) are opposite one another and arranged by 90° with respect to the base wall), while the tab (1) is foldable with respect to the first lateral wall (L1) in such a way that the second portion (12) is arranged between the two lateral walls (L1, L2) and opposite the first lateral wall (L1), and in such a way that the first portion (11), the third portion (13) and the fourth portion (14) are arranged at an angle both with respect to the first lateral wall (L1) and the second portion (12) so as to identify, between the first portion (11) and the third portion (13), and between the third portion (13) and the fourth portion (14), respective seatings (S1, S2) of dimensions that are suitable for receiving corresponding bottles.

Thanks to this particular folding method of the two lateral walls (L1, L2) and the tab (1), the container (100) can take on the opened-out configuration (V) and can receive a corresponding bottle in a vertical configuration in each of the seatings (S1, S2) with the bottom of the bottle resting on the base wall (B).

The cardboard container (100) of the present invention, different from the prior art cardboard containers, does not include any upper wall in a single body with the two lateral walls, but instead enjoys the advantageous presence of the tab (1), in a single body with a first transversal edge of a first lateral wall (L1).

By virtue of the particular shape of the tab (1) (presence of the first portion (11), foldable with respect to the first transversal edge (L11) of the first lateral wall (L1), second portion (12) foldable with respect to the first portion (11), third (13) and fourth portion (14), connected to the first lateral wall (L1) in two different positions and foldable with respect both to the second portion (12) and to the first lateral wall (L1)), when the two lateral walls (L1, L2) are folded with respect to the base wall, in order to be arranged opposite to one another, the tab (1) can be folded in the above-described way so as to create, between the relative reciprocally folded various portions and the first lateral wall, the seatings (S1, S2) for receiving the bottles.

The profile of the seatings (S1, S2) is thus defined only by the thickness of the first lateral wall (L1) and by the thickness of the tab (1), i.e. by the thickness of the cardboard of which the container is made, and consequently the dimensions of the base wall (B) can be predisposed in such a way that the transversal and longitudinal dimensions of the container (100) in the opened-out configuration (V) are modest in comparison to the containers made of a heat-formed plastic material, and therefore are smaller than the cardboard container at present used in the prior art and cited above.

The container (100) maintains the advantage of the cardboard containers obtained by a relative blank, i.e. the advantage of being able to assume a flattened configuration and thus of having, especially in height, a minimum volume such as to be stored in modestly-sized dimensions and smaller with respect to the case of use of containers made of plastic material.

The folding of the two lateral walls (L1, L2) with respect to the base wall (B), and the folding of the tab (1), with respect to the first lateral wall (L1), once the container (100) is extracted in a flattened configuration (I) from the store, can be done by using folding means which are usually adopted in the sector of automatic and/or semi-automatic packaging apparatus.

The dimensions of the tab (1), i.e. of the various portions making it up, and the positions in which the third portion (13) and the fourth portion (14) are connected to the first lateral wall (L1), are predisposed on the basis of the transversal dimensions of the bottles which are to be packed.

In particular, the length of the second portion (12) must be at least equal to the sum of the transversal dimensions of two bottles, while the third portion (13) will have to be connected to the first lateral wall (L1) in a first position (P1) which is distanced from the first transversal edge (L11) of the first lateral wall (L1) by a distance that is at least equal to the transversal dimension of a bottle and the fourth portion (14) connected to the first lateral wall (L1) in second position (P2) which is distanced from the first transversal edge (L11) by a distance that is at least equal to the sum of the transversal dimensions of two bottles, i.e. which is distanced from the first position (P1) by a distance that is at least equal to the transversal dimension of a bottle.

The cardboard container (100) of the present invention, on the basis of the number of bottles which is to be packed or the shape of the containers, can further include other tabs apart from the tab (1).

For example, the container (100) can also comprise at least a second tab (2) which this time is in a single body with a second lateral wall (L2) of the two lateral walls (L1, L2) at a first transversal edge (L21) thereof. The second tab (2) also exhibits a special shape corresponding to the shape of the tab (1).

The second tab (2) exhibits:

a first portion (21) which is foldable with respect to the first transversal edge (L21) of the second lateral wall (L2), a second portion (22), which is foldable with respect to the first portion (21) and which is of such a shape as to exhibit a first side (221) and a second side (222) which are at a different distance from the first portion (21), a third portion (23), which projects from the first side (221) of the second portion (22) and which is foldable with respect thereto and which is further connected to the second lateral wall (L2) in a first position (Z1) with respect to the first transversal edge (L21) so as to be foldable also with respect to the second lateral wall (L2), and a fourth portion (24) which projects from the second side (222) of the second portion and is foldable with respect thereto and which is further connected to the second lateral wall (L2) in a second position (Z2) with respect to the first transversal edge (L21) thereof in such a way as to be foldable also with respect to the second lateral wall (L2).

The second tab (2), when the two lateral walls (L1, L2) are folded with respect to the base wall (B) so as to be arrangeable on a same plane containing the base wall (B), externally of the two opposite longitudinal sides of the base wall (B), so as to place the container (100) in the flattened configuration (I), is foldable such that the relative first portion (21) is arranged by a flank of the second lateral wall (L2) and on the same plane as the second lateral wall (L2), and the relative second portion (22), third portion (23) and fourth portion (24) take on a flat configuration and are arranged on a same common plane above the second lateral wall (L2) and the second portion (22) (see for example FIG. 2, even though the first portion (21) is not visible as it is hidden below the second portion (22)).

The second tab (2), when the two lateral walls (L1, L2) are folded with respect to the base wall (B) so as to be arrangeable opposite to one another and so as to form an angle with respect to the base wall (B), for example of 90°, in order to place the container (100) in the opened-out configuration (V), is foldable with respect to the second lateral wall (L2) such that the relative second portion (22) is arranged between the two lateral walls (L1, L2) and opposite the second lateral wall (L2), and such that the first portion (21), the third portion (23) and the fourth portion (24) are arranged at an angle with respect both to the second lateral wall (L2) and the second portion (22) in such a way as to identify, between the first portion (21) and the third portion (23), and between the third portion (23) and the fourth portion (24), respective seatings (S3, S4) of suitable dimensions for receiving corresponding bottles.

In this way, as it has a tab (1) in a single body with the first edge (L11) of a first lateral wall (L1) and a second tab (2) in a single body with a first edge (L21) of a second lateral wall (L2), once the tab (1) and the second tab (2) are folded and the container (100) positioned in the opened-out configuration (V), two seating (S1, S2) are defined by the tab (1) and two seatings (S3, S4) by the second tab (2) for receiving four bottles.

The tab (1) is of such dimensions that the first portion (11) and the second portion (12) thereof exhibit transversal dimensions that are not greater than the transversal dimension of the first lateral wall (L1) and the second tab (2) is of such dimensions that the first portion (21) and the second portion (22) thereof exhibit transversal dimensions that are not greater than the transversal dimension of the second lateral wall (L2).

Other characteristics the container (10) of the present invention can have, when provided with the tab (1) and the second tab (2), are the following.

The base wall (B), the tab (1) and the second tab (2) can be dimensioned such that once the tab (1) and the second tab (2) are folded, and with the container (100) in the opened-out configuration (V), the second portion (12) of the tab (1) and the second portion (22) of the second tab (2) are arranged facing one another and in reciprocal contact.

The base wall (B), the tab (1) and the second tab (2) can be dimensioned such that once the tab (1) and the second tab (2) are folded, and with the container (100) in the opened-out configuration (V), the first portion (11) of the tab (1) and the first portion (21) of the second tab (2) are aligned in a position above the base wall (B) in proximity of or at a first transversal edge (B1) of the base wall (B), and the third portion (13) and the fourth portion (14) of the tab (1) are respectively aligned to the third portion (23) and the fourth portion (24) of the second tab (2).

Further, the base wall (B) can be dimensioned such that, and the first tab (1) and the second tab (2) can be dimensioned in such a way that, once folded and with the container (100) in the opened-out configuration (V), the fourth portion (14) of the tab (1) and the fourth portion of the second tab (2) are aligned to one another above the base wall (B) and in proximity of or at the second transversal edge (B2) of the base wall (B).

In the preferred embodiment which is described and illustrated by way of example in the accompanying figures, the container (100) exhibits a base wall (B) which exhibits dimensions that are such that the container (100) further comprises a third tab (3) and a fourth tab (4).

The third tab (3) is in a single body with the first lateral wall (L1) at a second transversal edge (L12) thereof and exhibits an identical shape to the tab (1) and is foldable like the tab (1), while the fourth tab (4) is in a single body with the second lateral wall (L2) at a second transversal edge (L22) thereof and exhibits an identical shape to and is foldable like the second tab (2).

In detail, the third tab (3) has a shape so as to exhibit:

a first portion (31), which is foldable with respect to the second transversal edge (L12) of the first lateral wall (L1), a second portion (32), which is foldable with respect to the first portion (31) and which is of such a shape as to exhibit a first side (321) and a second side (322) which are at a different distance from the first portion (31), a third portion (33), which is foldable with respect to the first side (321) of the second portion (32) and which is further connected to the first lateral wall (L1) in a first position (P3) with respect to the second transversal edge (L12) so as to be foldable also with respect to the first lateral wall (L1), and a fourth portion (34), which is foldable with respect to the second side (322) of the second portion (32) and which is connected to the first lateral wall (L1) in a second position (P4) with respect to the second transversal edge (L12) thereof so as to be foldable also with respect to the first lateral wall (L1).

The fourth tab (4) has a shape so as to correspondingly exhibit:

a first portion (41), which is foldable with respect to the second transversal edge (L22) of the second lateral wall (L2), a second portion (42) which is foldable with respect to the first portion (41) and which is of such a shape as to exhibit a first side (421) and a second side (422) which are at a different distance from the first portion (41), a third portion (43), which projects from the first side (421) of the second portion (42) and is foldable with respect thereto and which is further connected to the second lateral wall (L2) in a first position (Z3) with respect to the second transversal edge (L22) such as to be foldable also with respect to the second lateral wall (L2), and a fourth portion (44) which projects from the second side (422) of the second portion (42) and is foldable thereto, and which is further connected to the second lateral wall (L2) in a second position (Z4) with respect to the second transversal edge (L2) thereof in such a way as to be foldable also with respect to the second lateral wall (L2).

In this case, when the container (100) is placed in the flattened configuration (I), the third tab (3) is foldable such that the relative first portion (31) is arranged by a flank of the first lateral wall (L1) and on the same plane as the first lateral wall (L1), and the relative second portion, third portion (33) and fourth portion (34) take on a flat configuration and are arranged on a same common plane above the first lateral wall (L1) and the first portion (31), while the fourth tab (4) is foldable in such a way that the relative first portion (41) is arranged by a flank of the second lateral wall (L2) and on the same plane as the second lateral wall (L2), and the relative second portion (42), third portion (43) and fourth portion (44) take on a flat configuration and are arranged on a same common plane above the second lateral wall (L2) and the first portion (41) (see FIG. 2).

Differently, when the container (100) is brought into the opened-out configuration (V), the third tab (3) is foldable with respect to the first lateral wall (L1) in such a way that the relative second portion (32) is arranged between the two lateral walls (L1, L2) and opposite the first lateral wall (L1) and in such a way that the first portion (31), the third portion (33) and the fourth portion (34) are arranged at an angle with respect to both the first lateral wall (L1) and the second portion (32) such as to identify, between the first portion (31) and the third portion, and between the third portion (33) and the fourth portion (34), respective seatings (S5, S6) having suitable dimensions for receiving corresponding bottles in a vertical configuration, while the fourth tab (4) is foldable with respect to the second lateral wall (L2) such that the relative second portion (42) is arranged between the two lateral walls (L1, L2) and opposite the second lateral wall (L2), and such that the first portion (41), the third portion (43) and the fourth portion (44) are arranged at an angle both with respect to the second lateral wall (L2) and the second portion (42) so as to identify, between the first portion (41) and the third portion (43), and between the third portion (43) and the fourth portion (44), respective seatings (S7, S8) having suitable dimensions for receiving corresponding bottles in a vertical configuration.

In particular, the third tab (3) and the fourth tab (4) are advantageously of such dimensions that once folded and with the container (100) in the opened-out configuration (V), the second portion (32) of the third tab (3) and the second portion (42) of the fourth tab (4) are arranged facing one another and in reciprocal contact, and such that the first portion (31) of the third tab (3) and the first portion (41) of the fourth tab (4) are aligned to one another in a position above the base wall (B) in proximity of or at the second transversal edge (B1) of the base wall (B) and the third portion (33) and the fourth portion (34) of the third tab (3) are respectively aligned with the third portion (43) and the fourth portion (44) of the fourth tab (4).

Further, as shown in the preferred but not exclusive embodiment of the invention illustrated in the accompanying figures, advantageously and with the aim of further increasing the number of bottles that can be received in the container, the base wall (B), the tab (1), the second tab (2), the third tab (3) and the fourth tab (4) are of dimensions such that once folded and with the container (100) in the opened-out configuration (V), the fourth portion (14) of the tab (1) and the fourth portion (34) of the third tab (3) are opposite one another and at a distance so as to define therebetween a seating (S9) for inserting a bottle in a vertical configuration, and such that the fourth portion (24) of the second tab (2) and the fourth portion (44) of the fourth tab (4) are opposite one another and at such a distance as to define therebetween a seating (S10) for inserting a bottle in the vertical configuration.

In this case the container (100) can receive up to 10 bottles.

Lastly, the container (100) can comprise a first wing (71), in a single body with the first transversal edge (B1) of the base wall (B), and a second wing (72), in a single body with the second transversal edge (B2) of the base wall (B), the first wing (71) and the second wing (72) being foldable with respect to the base wall (B) so as to be folded at an angle with respect to the base wall (B) towards the two lateral walls (L1, L2) when the container (100) is placed in the opened-out configuration (V) such as to stabilize the container (100).

In this regard, at least the first wing (71) exhibits dimensions that are such as to be provided with gluing means and such that, once folded at an angle with respect to the base wall (B) towards the two lateral walls (L1, L2), it can be glued to the first portion (11) of the tab (1) or the first portion (21) of the second tab (2) or both, such as to stabilize the opened-out configuration (V) of the container (100).

In the same way, the second wing (72) too can exhibit dimensions that are such as to be predisposed with gluing means and such that once folded at an angle with respect to the base wall (B) towards the two lateral walls (L1, L2), the second wing (72) can be glued to the fourth portion (14) of the tab (1), and/or to the fourth portion (24) of the second tab (2), in a case in which the container (100) has only the tab (1) or the second tab (2), or be glued to the first portion (31) of the third tab (3) and/or to the first portion of the fourth tab (4) in a case in which the container (100) also has the third tab (3) and the fourth tab (4).

Further, the first wing (71) and the second wing (72) are also foldable with respect to the base (B) in such a way as to be arranged on the same plane as the base wall (B), with the container (100) in the flattened configuration (1).

Figure 3:
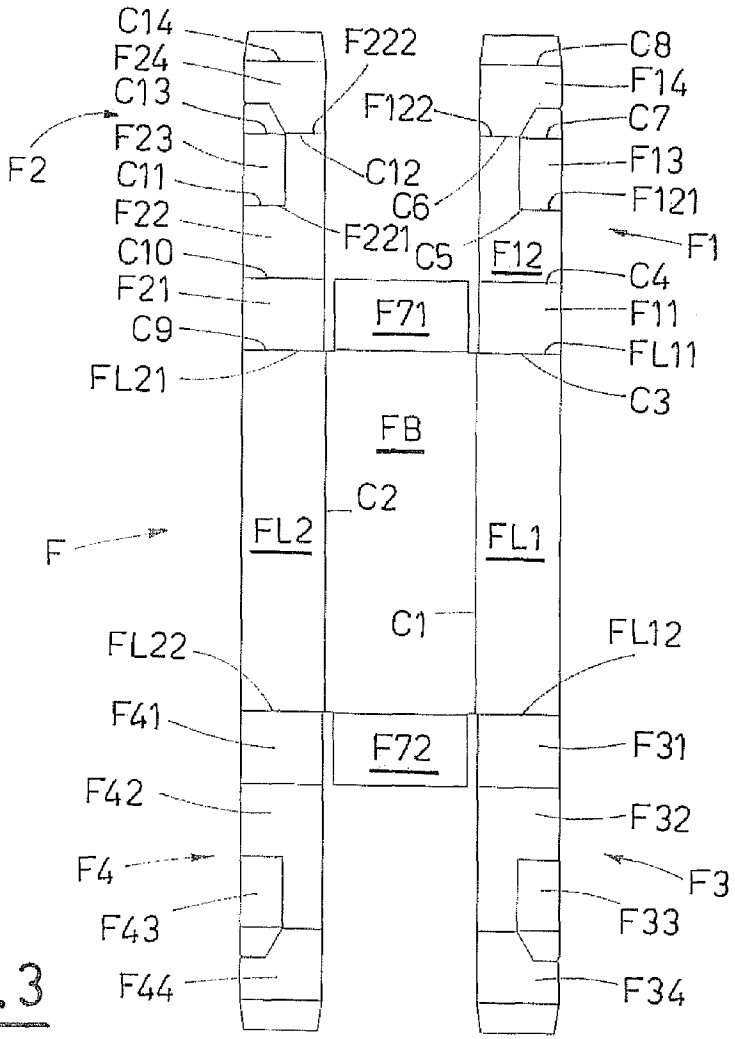
FIG. 3 illustrates, once more in a view from above, the blank of the invention, from which the container of FIG. 1 is obtainable by folding thereof.

FIG. 3 illustrates the cardboard blank (F) from which the above described cardboard container (100) can be obtained.

The cardboard blank (F) is obtainable from a single cardboard or card sheet by means of cutting operations as normally used in the paper industry.

The blank (F) is therefore a single piece made of cardboard or card and exhibits a special shape.

The blank (F) comprises: a central section (FB), a first lateral section (FL1) and a second lateral section (FL2), arranged at the opposite longitudinal signs of the central section (FB).

The central section (FB) will constitute the base wall (B) of the container while the first lateral section (FL1) will constitute the first lateral wall (L1) and the second lateral wall (L2) the second lateral wall (L2).

The blank (F) comprises, in this respect: a first fold line (C1) between the central section (FB) and the first lateral section (FL1), such as to enable folding the first lateral section (FL1) with respect to the central section (FB) such that the first lateral section (FL1) can be arranged indifferently both on the same plane as the central section (FB), externally of the central section (FB), and in an angled position with respect to the central section (FB), and a second fold line (C2) between the central section (FB) and the second lateral section (FL2), so as to enable folding the second lateral section (FL2) with respect to the central section (FB) such that the second lateral section (FL2) can be arranged indifferently both on the same plane as the central section (FB), externally of the central section (FB), and in an angled position with respect to the central section (FB).

The blank (F) also comprises at least a tab (F1) exhibiting a first portion (F11), in a single body with a first transversal edge (FL11) of the first lateral section (FL1), a second portion (F12) having a form so as to exhibit a first side (F121) and a second side (F122) which are at a different distance from the first portion (F11), a third portion (F13) projecting from the first side (F121) of the second portion (F12) and a fourth portion (F14) projecting from the second side (F122) of the second portion (F12).

The tab (F1), once folded with respect to the first transversal edge (FL11) and connected to the first lateral section (FL1) will constitute the tab (1) of the container (100).

In this regard, the blank (F) comprises:

a third fold line (C3) at the first transversal edge (F11), between the first portion (F11) of the tab (F1) and the first lateral section (FL1), so as to enable the first portion (F11) to be foldable with respect to the first lateral section (FL1), a fourth fold line (V4) between the first portion (F11) and the second portion (F12) of the tab (F1) such as to enable the second portion (F12) to be foldable with respect to the first portion (F11), a fifth fold line (V4) at the first side (F121) between the second portion (F12) and the third portion (F13), such as to enable the third portion (F13) to be foldable with respect to the second portion (F12), and a sixth fold line (C6) at the second side (F122), between the second portion (F12) and the fourth portion (F14), such as to enable the fourth portion (F14) to be foldable with respect to the second portion (F12).

In this way, the second portion (F12) is predisposed to be folded with respect to the first portion (F11), about the fourth fold line (C4), in such a way as to enable the third portion (F13) to be fixed to the first lateral section (FL1) at a first portion (P1) and the fourth portion (F14) being able to be fixed to the first lateral section (FL1) at a second position (P2) at a greater distance with respect to the first transversal edge (FL11) of the first lateral section (FL1).

Further, the blank (F) also comprises:

a seventh fold line (C7) at the side of the third portion (F13) destined to be fixed to the first lateral section (FL1) in such a way as to enable the third portion (F13) to be foldable with respect to the first lateral section (FL1), once fixed thereto;

an eighth fold line (C8) at the side of the fourth portion (F14) destined to be fixed to the first lateral section (FL1) in such a way as to enable the fourth portion (F14) to be foldable with respect to the first lateral section (FL1) once fixed thereto.

The blank (F) can also comprise at least a second tab (F2) exhibiting a first portion (F21), in a single body with a first transversal edge (FL21) of the second lateral section (FL2), a second portion (F22) having a shape such as to exhibit a first side (F221) and a second side (F222) which are at a different distance from the first portion (F21), a third portion (F23) projecting from the first side (F221) of the second portion (F22) and a fourth portion (F24) projecting from the second side (F222) of the second portion (F22).

In this case the blank (F) comprises:

a ninth fold line (C9) at the first transversal edge (FL21), between the first portion (F21) of the second tab (F2) and the second lateral section (FL2), such as to enable the first portion (F21) to be foldable with respect to the second lateral section (F21), a tenth fold line (C10) between the first portion (F21) and the second portion (F22) of the second tab (F2), such as to enable the second portion (F22) to be foldable with respect to the first portion (F21), an eleventh fold line (C11) at the first side (F221), between the second portion (F22) and the third portion (F23) such as to enable the third portion (F23) to be foldable with respect to the second portion (F22), and a twelfth fold line (C12) at the second side (F222), between the second portion (F22) and the fourth portion (F24), such as to enable the fourth portion (F24) to be foldable with respect to the second portion (F22).

In this way, the second portion (F22) is predisposed to be folded with respect to the first portion (F21), about the tenth fold line (C10), in such a way as to enable the third portion (F23) to be fixed to the second lateral section (FL2) at a first portion (Z1) and the fourth portion (F24) to be fixed to the second lateral section (FL2) at a second position (Z2) at a greater distance with respect to the first transversal edge (FL21) of the second lateral section (FL2).

Further, the blank (F) further comprises:

a thirteenth fold line (C13) at the side of the third portion (F23) destined to be fixed to the second lateral section (FL2) in such a way as to enable the third portion (F23) to be foldable with respect to the second lateral section (FL2), once fixed thereto, a fourteenth fold line (C14) at the side of the fourth portion (F24) destined to be fixed to the second lateral section (FL2) in such a way as to enable the fourth portion (F24) to be foldable with respect to the second lateral section (FL2), once fixed thereto.

Lastly, according to the number of bottles which are to be packed inside a same box, the blank (F) can be made in such a way that the central portion (FB) exhibits dimensions such that the blank (F) also includes a third tab (F3) having a shape and structure identical to the tab (1), and also a fourth tab (F4) having a shape and a structure identical to the second tab (F2).

In particular, the third tab (F3) has a shape so as to exhibit a first portion (F31), in a single body with a second transversal edge (FL12) of the first lateral section (FL1) and foldable with respect thereto, a second portion (F32), a third portion (F33) and a fourth portion (F34), with the third portion (F33) being destined to be fixed to the first lateral section (FL1) in a first position (P3) and with the fourth portion (F34) destined to be fixed to the first lateral section (FL1) in a second position (P4).

As in the case of the tab (F1) relative fold lines are present between the second transversal edge (FL12) of the first lateral section (FL1) and the first portion (F31) of the third tab (F3), between the first portion (F31) and the second portion (F32), between the third portion (33) and the second portion (F32) and between the fourth portion (F34) and the second portion (F32).

The fourth tab (F4) has a shape so as to exhibit a first portion (F41), in a single body with a second transversal edge (FL22) of the second lateral section (FL2) and foldable with respect thereto, a second portion (F42), a third portion (F43) and a fourth portion (F44), with the third portion (F43) destined to be fixed to the second lateral section (FL2) in a first position (Z3) and with the fourth portion (F44) destined to be fixed to the second lateral section (FL2) in a second position (Z4).

As in the case of the second tab (F2) fold lines will be present between the second transversal edge (FL22) of the second lateral section (FL2) and the first portion (F41) of the fourth tab (F4), between the first portion (F41) and the second portion (F42), between the third portion (43) and the second portion (F42) and between the fourth portion (F44) and the second portion (F42).

Lastly, the blank (F) comprises a first wing (F71) at a first transversal edge of the central section (FB) and a second wing (F72) at a second transversal edge of the central section (FB) and corresponding fold lines between the first wing (F71) and the central section (FB) and between the second wing (F72) and the central section (FB) such that the first wing (F71) and the second wing (F72) are foldable with respect to the central section (FB).

The above has been described by way of non-limiting examples, and any constructional variants made thereto are understood to fall within the scope of the following claims.

The invention claimed is:

1. A cardboard container for receiving bottles in a vertical configuration comprising:

a base wall (B), two lateral walls (L1, L2) which are in a single body with the base wall (B) with a relative longitudinal side respectively at two opposite longitudinal sides of the base wall (B) and which are foldable with respect to the base wall (B) so as to enable the container (100) to take on a flattened configuration (I) and an opened-out configuration (V);

at least one tab (1), in a single body with a first lateral wall (L1) of the two lateral walls (L1, L2) at a first transversal edge (L11) thereof, the tab (1) exhibiting a first portion (11) which is foldable with respect to the first transversal edge (L11) of the first lateral wall (L1);

a second portion (12), which is foldable with respect to the first portion (11) and which is of such a shape as to exhibit a first side (121) and a second side (122) which are at a different distance from the first portion (11);

a third portion (13), which is foldable with respect to the first side (121) of the second portion (12) and which is connected to the first lateral wall (L1) in a first position (P1) with respect to the first transversal edge (L11) so as to be foldable also with respect to the first lateral wall (L1);

a fourth portion (14), which is foldable with respect to the second side (122) of the second portion (12) and which is connected to the first lateral wall (L1) in a second position (P2) with respect to the first transversal edge (L11) so as to be foldable also with respect to the first lateral wall (L1);

wherein the two lateral walls (L1, L2) are foldable with respect to the base wall (B) so as to be arrangeable on a same plane containing the base wall (B), externally of the two opposite longitudinal sides of the base wall (B), and with the tab (1) being foldable in such a way that the first portion (11) thereof becomes arranged by a flank of the first lateral wall (L1) and on the same plane as the first lateral wall (L1) and that the second portion (12), third portion (13) and fourth portion (14) take on a flat configuration and are arranged on a same common plane above the first lateral wall (L1) and the first portion (11), in such a way that the container (100) can take on the flattened configuration (I); and, wherein the two lateral walls (L1, L2) are further foldable with respect to the base wall (B) so as to be arrangeable opposite to one another and in such a way as to form an angle with respect to the base wall (B), the tab (1) being foldable with respect to the first lateral wall (L1) in such a way that the second portion (12) is arranged between the two lateral walls (L1, L2) and opposite the first lateral wall (L1), and in such a way that the first portion (11), the third portion (13) and the fourth portion (14) are arranged at an angle both with respect to the first lateral wall (L1) and the second portion (12) so as to identify, between the first portion (11) and the third portion (13), and between the third portion (13) and the fourth portion (14), respective seatings (S1, S2) of dimensions that are suitable for receiving corresponding bottles, such that the container (100) can take on the opened-out configuration (V) and receive a corresponding bottle in a vertical configuration in each of the seatings with the bottom of the bottle resting on the base wall (B).

2. The container of claim 1, further comprising at least one second tab (2), in a single body with a second lateral wall (L2) of the two lateral walls (L1, L2), at a first transversal edge (L21) thereof, the second tab (2) exhibiting a first portion (21) which is foldable with respect to the first transversal edge (L21) of the second lateral wall (L2), a second portion (22), which is foldable with respect to the first portion (21) and which is of such a shape as to exhibit a first side (221) and a second side (222) which are at a different distance from the first portion, a third portion (23), which is foldable with respect to the first side (221) of the second portion (22) and which is connected to the second lateral wall (L2) in a first position (Z1) with respect to the first transversal edge (L21) so as to be foldable also with respect to the second lateral wall (L2), and a fourth portion (24) which is foldable with respect to the second side (222) of the second portion (22) and which is connected to the second lateral wall (L2) in a second position (22) with respect to the first transversal edge (L21) thereof so as to be foldable also with respect to the second lateral wall (L2), and wherein the second tab (2), when the two lateral walls (L1, L2) are folded with respect to the base wall (B) so as to be arrangeable on a same plane containing the base wall (B), externally of the two opposite longitudinal sides of the base wall (B), so as to place the container (100) in the flattened configuration (I), is foldable such that the relative first portion (21) is arranged by a flank of the second lateral wall (L2) and on the same plane as the second lateral wall (L2), and the relative second portion, third portion (23) and fourth portion (24) take on a flat configuration and are arranged on a same common plane above the second lateral wall (L2) and the second portion (22), and wherein the second tab (2), when the two lateral walls (L1, L2) are folded with respect to the base wall (B) so as to be arrangeable opposite to one another and so as to form an angle with respect to the base wall (B), in order to place the container (100) in the opened-out configuration (V), is foldable with respect to the second lateral wall (L2) such that the relative second portion (22) is arranged between the two lateral walls (L1, L2) and opposite the second lateral wall (L2), and such that the first portion (21), the third portion (23) and the fourth portion (24) are arranged at an angle with respect both to the second lateral wall (L2) and the second portion (22) so as to identify, between the first portion (21) and the third portion (23), and between the third portion (23) and the fourth portion (24), respective seatings (S3, S4) of suitable dimensions for receiving corresponding bottles.

3. The container of claim 2, wherein the tab (1) is of such dimensions that the first portion (11) and the second portion (12) thereof exhibit transversal dimensions that are not greater than the transversal dimension of the first lateral wall (L1) and the second tab (2) is of such dimensions that the first portion (21) and the second portion (22) thereof exhibit transversal dimensions that are not greater than the transversal dimension of the second lateral wall (L2).

4. The container of claim 3, wherein the base wall (B), the tab (1) and the second tab (2) are of such dimensions that once the tab (1) and the second tab (2) are folded, and with the container (100) in the opened-out configuration (V), the second portion (12) of the tab (1) and the second portion (22) of the second tab (2) are arranged facing and in reciprocal contact.

5. The container of claim 3, wherein the base wall (B), the tab (1) and the second tab (2) are dimensioned such that once the tab (1) and the second tab (2) are folded, and with the container (100) in the opened-out configuration (V), the first portion (11) of the tab (1) and the first portion (21) of the second tab (2) are aligned in a position above the base wall (B) in proximity of or at a first transversal edge (B1) of the base wall (B), and the third portion (13) and the fourth portion (14) of the tab (1) are respectively aligned to the third portion (23) and the fourth portion (24) of the second tab (2).

6. The container of claim 5, wherein the base wall (B), the first tab (1) and the second tab (2) exhibits dimensions such that, once folded and with the container (100) in the opened-out configuration (V), the fourth portion (14) of the tab (1) and the fourth portion of the second tab (2) are aligned with one another above the base wall (B) and in proximity of or at the second transversal edge (B2) of the base wall (B).

7. The container of claim 5, wherein the base wall (B) exhibits dimensions such that the container (100) further comprises a third tab (3) and a fourth tab (4), with the third tab (3) in a single body with the first lateral wall (L1) at a second transversal edge (L12) thereof and exhibiting an identical shape to the tab (1), the fourth tab (4) being in a single body with the second lateral wall (L2) at a second transversal edge (L22) thereof and exhibiting an identical shape to the second tab (2).

8. The container of claim 7, wherein the third tab (3) exhibits a first portion (31), which is foldable with respect to the second transversal edge (L12) of the first lateral wall (L1), a second portion (32), which is foldable with respect to the first portion (31) and which is of such a shape as to exhibit a first side (321) and a second side (322) which are at a different distance from the first portion (31), a third portion (33), which is foldable with respect to the first side (321) of the second portion (32) and which is connected to the first lateral wall (L1) in a first position (P3) with respect to the second transversal edge (L12) so as to be foldable also with respect to the first lateral wall (L1) and a fourth portion (34), which is foldable with respect to the second side (322) of the second portion (32) and which is connected to the first lateral wall (L1) in a second position (P4) with respect to the second transversal edge (L12) thereof so as to be foldable also with respect to the first lateral wall (L1), and that the fourth tab (4) exhibits a first portion (41), which is foldable with respect to the second transversal edge (L22) of the second lateral wall (L2), a second portion (42) which is foldable with respect to the first portion (41) and which is of such a shape as to exhibit a first side (421) and a second side (422) which are at a different distance from the first portion (41), a third portion (43), which is foldable with respect to the first side (421) of the second portion (42) and which is connected to the second lateral wall (L2) in a first position (Z3) with respect to the second transversal edge (L22) such as to be foldable also with respect to the second lateral wall (L2), and a fourth portion (44) which is foldable with respect to the second side (422) of the second portion (42) and which is connected to the second lateral wall (L2) in a second position (Z4) with respect to the second transversal edge (L2) thereof so as to be foldable also with respect to the second lateral wall (L2).

9. The container of claim 8, wherein when the container (100) is placed in the flattened configuration (I), the third tab (3) is foldable such that the relative first portion (31) is arranged by a flank of the first lateral wall (L1) and on the same plane as the first lateral wall (L1), and the relative second portion (32), third portion (33) and fourth portion (34) take on a flat configuration and are arranged on a same common plane above the first lateral wall (L1) and the first portion (31), and the fourth tab (4) is foldable such that the relative first portion (41) is arranged by a flank of the second lateral wall (L2) and on the same plane as the second lateral wall (L2), and the relative second portion (42), third portion (43) and fourth portion (44) take on a flat configuration and are arranged on a same common plane above the second lateral wall (L2) and the first portion (41).

10. The container of claim 8, wherein when the container (100) is brought into the opened-out configuration (V), the third tab (3) is foldable with respect to the first lateral wall (L1) such that the relative second portion (32) is arranged between the two lateral walls (L1, L2) and opposite the first lateral wall (L1), the first portion (31), the third portion (33) and the fourth portion (34) being arranged at an angle with respect to both the first lateral wall (L1) and the second portion (32) so as to identify, between the first portion (31) and the third portion (33), and between the third portion (33) and the fourth portion (34), respective seatings (S5, S6) having suitable dimensions for receiving corresponding bottles in a vertical configuration, and the fourth tab (4) is foldable with respect to the second lateral wall (L2) such that the relative second portion (42) is arranged between the two lateral walls (L1, L2) and opposite the second lateral wall (L2), and such that the first portion (41), the third portion (43) and the fourth portion (44) are arranged at an angle both with respect to the second lateral wall (L2) and the second portion (42) so as to identify, between the first portion (41) and the third portion (43), and between the third portion (43) and the fourth portion (44), respective seatings (S7, S8) dimensioned for receiving corresponding bottles in a vertical configuration.

11. The container of claim 10, wherein the third tab (3) and the fourth tab (4) are of such dimensions that once folded and with the container (100) in the opened-out configuration (V), the second portion (32) of the third tab (3) and the second portion (42) of the fourth tab (4) are arranged facing one another and in reciprocal contact, and such that the first portion (31) of the third tab (3) and the first portion (41) of the fourth tab (4) are aligned to one another in a position above the base wall (B) in proximity of or at the second transversal edge (B1) of the base wall (B) and the third portion (33) and the fourth portion (34) of the third tab (3) are respectively aligned with the third portion (43) and the fourth portion (44) of the fourth tab (4).

12. The container of claim 11, wherein the base wall (B), the tab (1), the second tab (2), the third tab (3) and the fourth tab (4) are of dimensions such that once folded and with the container (100) in the opened-out configuration (V), the fourth portion (14) of the tab (1) and the fourth portion (34) of the third tab (3) are opposite one another and at a distance such as to define there-between a seating (S9) for inserting a bottle in a vertical configuration, and such that the fourth portion (24) of the second tab (2) and the fourth portion (44) of the fourth tab (4) are opposite one another and at such a distance as to define therebetween a seating (S10) for inserting a bottle in the vertical configuration.

13. The container of claim 1, further comprising a first wing (71), in a single body with the first transversal edge (B1) of the base wall (B), and a second wing (72), in a single body with the second transversal edge (B2) of the base wall (B), the first wing (71) and the second wing (72) being foldable with respect to the base wall (B) so as to be arranged on the same plane as the base wall (B), with the container (100) in the flattened configuration (I), and so as to be folded at an angle with respect to the base wall (B) towards the two lateral walls (L1, L2) when the container (100) is placed in the opened-out configuration (V) so as to stabilize the container (100), and wherein at least the first wing (71) exhibits dimensions that are such as to be provided with gluing means and such that, once folded at an angle with respect to the base wall (B) towards the two lateral walls (L1, L2), the first wing can be glued to the first portion (11) of the tab (1) or the first portion (21) of the second tab (2) or both, so as to stabilize the opened-out configuration (V) of the container (100).

14. A cardboard blank, usable for obtaining a cardboard container according to claim 1, for receiving bottles in a vertical configuration, further comprising:

a central section (FB), a first lateral section (FL1) and a second lateral section (FL2) arranged at opposite longitudinal sides of the central section (FB), a first fold line (C1) between the central section (FB) and the first lateral section (FL1), such as to enable folding the first lateral section (FL1) with respect to the central section (FB) such that the first lateral section (FL1) can be arranged indifferently both on the same plane as the central section (FB), externally of the central section (FB), and in an angled position with respect to the central section (FB), a second fold line (C2) between the central section (FB) and the second lateral section (FL2), such as to enable folding the second lateral section (FL2) with respect to the central section (FB) such that the second lateral section (FL2) can be arranged indifferently both on the same plane as the central section (FB), externally of the central section (FB), and in an angled position with respect to the central section (FB), at least one tab (F1) exhibiting a first portion (F11), in a single body with a first transversal edge (FL11) of the first lateral section (FL1), a second portion (F12) having a form so as to exhibit a first side (F121) and a second side (F122) which are at a different distance from the first portion (F11), a third portion (F13) projecting from the first side (F121) of the second portion (F12) and a fourth portion (F14) projecting from the second side (F122) of the second portion (F12), a third fold line (C3) located at the first transversal edge (F11), between the first portion (F11) of the tab (F1) and the first lateral section (FL1), to enable the first portion (F11) to be foldable with respect to the first lateral section (FL1), a fourth fold line (V4) located between the first portion (F11) and the second portion (F12) of the tab (F1) to enable the second portion (F12) to be foldable with respect to the first portion (F11), a fifth fold line (C5) located at the first side (F121), between the second portion (F12) and the third portion (F13), to enable the third portion (F13) to be foldable with respect to the second portion (F12), and a sixth fold line (C6) located at the second side (F122), between the second portion (F12) and the fourth portion (F14), to enable the fourth portion (F14) to be foldable with respect to the second portion (F12), the second portion (F12) being predisposed to be folded with respect to the first portion (F11), about the fourth fold line (C4), so as to enable the third portion (F13) to be fixed to the first lateral section (FL1) at a first portion (P1) and the fourth portion (F14) being able to be fixed to the first lateral section (FL1) at a second position (P2) at a greater distance with respect to the first transversal edge (FL11) of the first lateral section (FL1).

15. The cardboard blank of claim 14, further comprising a seventh fold line (C7) located at the third portion (F13) destined to be fixed to the first lateral section (FL1) to enable the third portion (F13) to be foldable with respect to the first lateral section (FL1), once fixed thereto, and an eighth fold line (C8) located at the side of the fourth portion (F14) destined to be fixed to the first lateral section (FL1) to enable the fourth portion (F14) to be foldable with respect to the first lateral section (FL1) once fixed thereto.

16. The cardboard blank of claim 14, further comprising at least one second tab (F2) exhibiting a first portion (F21), in a single body with a first transversal edge (FL21) of the second lateral section (FL2), a second portion (F22) having a shape so as to exhibit a first side (F221) and a second side (F222) which are at a different distance from the first portion (F21), a third portion (F23) projecting from the first side (F221) of the second portion (F22) and a fourth portion (F24) projecting from the second side (F222) of the second portion (F22), a ninth fold line (C9) located at the first transversal edge (FL21), between the first portion (F21) of the second tab (F2) and the second lateral section (FL2), so as to enable the first portion (F21) to be foldable with respect to the second lateral section (F21), a tenth fold line (C10) between the first portion (F21) and the second portion (F22) of the second tab (F2), to enable the second portion (F22) to be foldable with respect to the first portion (F21), an eleventh fold line (C11) at the first side (F221), between the second portion (F22) and the third portion (F23) to enable the third portion (F23) to be foldable with respect to the second portion (F22), and a twelfth fold line (C12) at the second side (F222), between the second portion (F22) and the fourth portion (F24), to enable the fourth portion (F24) to be foldable with respect to the second portion (F22), the second portion (F22) being predisposed to be folded with respect to the first portion (F21), about the tenth fold line (C10), so as to enable the third portion (F23) to be fixed to the second lateral section (FL2) at a first portion (Z1) and the fourth portion (F24) to be fixed to the second lateral section (FL2) at a second position (Z2) at a greater distance with respect to the first transversal edge (FL21) of the second lateral section FL2).

17. The blank of claim 16, further comprising a thirteenth fold line (C13) located at the side of the third portion (F23) destined to be fixed to the second lateral section (FL2) to enable the third portion (F23) to be foldable with respect to the second lateral section (FL2), once fixed thereto, a fourteenth fold line (C14) located at the side of the fourth portion (F24) destined to be fixed to the second lateral section (FL2) to enable the fourth portion (F24) to be foldable with respect to the second lateral section (FL2), once fixed thereto.

18. The blank of claim 17, further comprising a third tab (F3) having a shape and structure identical to the tab (1), exhibiting a first portion (F31) in a single body with a second transversal edge (FL12) of the first lateral section (FL1) and foldable with respect thereto, a second portion (F32), a third portion (F33) and a fourth portion (F34), with the third portion (F33) being destined to be fixed to the first lateral section (FL1) in a first position (P3) and with the fourth portion (F34) destined to be fixed to the first lateral section (FL1) in a second position (P4), and a fourth tab (F4) having a shape and structure identical to the second tab (F2), exhibiting a first portion (F41), in a single body with a second transversal edge (FL22) of the second lateral section (FL2) and foldable with respect thereto, a second portion (F42), a third portion (F43) and a fourth portion (F44), with the third portion (F43) destined to be fixed to the second lateral section (FL2) in a first position (Z3) and with the fourth portion (F44) destined to be fixed to the second lateral section (FL2) in a second position (Z4).

19. The blank of claim 14, further comprising a first wing (F71) at a first transversal edge of the central section (FB) and a second wing (F72) at a second transversal edge of the central section (FB), corresponding fold lines located between the first wing (F71) and the central section (FB) and between the second wing (F72) and the central section (FB) in such a way that the first wing (F71) and the second wing (F72) are foldable with respect to the central section (FB).

* * * * *